US006595025B2

(12) United States Patent
Lau

(10) Patent No.: US 6,595,025 B2
(45) Date of Patent: Jul. 22, 2003

(54) JEWELRY PIECE

(75) Inventor: Tak Choi Lau, New York, NY (US)

(73) Assignee: Createch, Inc., New York, NY (US)

( * ) Notice: Subject to any disclaimer, the term of this patent is extended or adjusted under 35 U.S.C. 154(b) by 62 days.

(21) Appl. No.: 09/883,875

(22) Filed: Jun. 18, 2001

(65) Prior Publication Data

US 2002/0189282 A1 Dec. 19, 2002

(51) Int. Cl.[7] ..... A44C 5/00

(52) U.S. Cl. ..... 63/3.1; 63/1.11; 63/1.16; 63/3; 63/3.2

(58) Field of Search ..... 63/1.11, 1.16, 63/1.17, 3, 3.1, 3.2

(56) References Cited

U.S. PATENT DOCUMENTS

| | | | | | |
|---|---|---|---|---|---|
| 1,044,686 | A | | 11/1912 | Osmers | |
| D57,180 | S | | 2/1921 | Miller | |
| 1,646,999 | A | | 10/1927 | Goodridge | |
| 2,051,591 | A | * | 8/1936 | Brogan | 24/116 A |
| 2,228,686 | A | | 1/1941 | Bezault | |
| 2,266,074 | A | * | 12/1941 | Rauer | 24/616 |
| 2,586,758 | A | * | 2/1952 | Zerr | 24/518 |
| 2,598,597 | A | * | 5/1952 | Philippe | 267/71 |
| 2,644,992 | A | | 7/1953 | McFarland | |
| 3,135,031 | A | | 6/1964 | Brosse | |
| 4,527,316 | A | | 7/1985 | Murphy | |
| 4,628,708 | A | | 12/1986 | Ivey | |
| 5,341,659 | A | | 8/1994 | Wright | |
| 5,410,784 | A | * | 5/1995 | Katz | 24/587.1 |
| 5,689,867 | A | | 11/1997 | Katz | |
| 5,946,728 | A | | 9/1999 | Tane | |
| 6,014,871 | A | | 1/2000 | Romano | |
| 6,112,373 | A | * | 9/2000 | Steinhauer et al. | 24/68 J |
| 6,422,036 | B1 | * | 7/2002 | Giannis et al. | 63/3.1 |

* cited by examiner

*Primary Examiner*—William L. Miller
*Assistant Examiner*—Andrea Chop
(74) *Attorney, Agent, or Firm*—Stephen E. Feldman

(57) ABSTRACT

A jewelry piece to hold the ends of a plurality of parallel beaded jewelry strings has two interdigitated U shaped bodies. Each body has a slot along at least one edge in which to slide the end pieces of each bead string. This jewelry piece can be used as a coupling for a necklace or bracelet or for an earring with hanging beaded strings.

17 Claims, 5 Drawing Sheets

FIG. 7
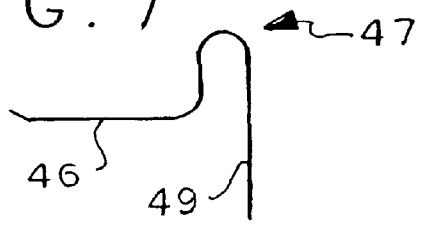
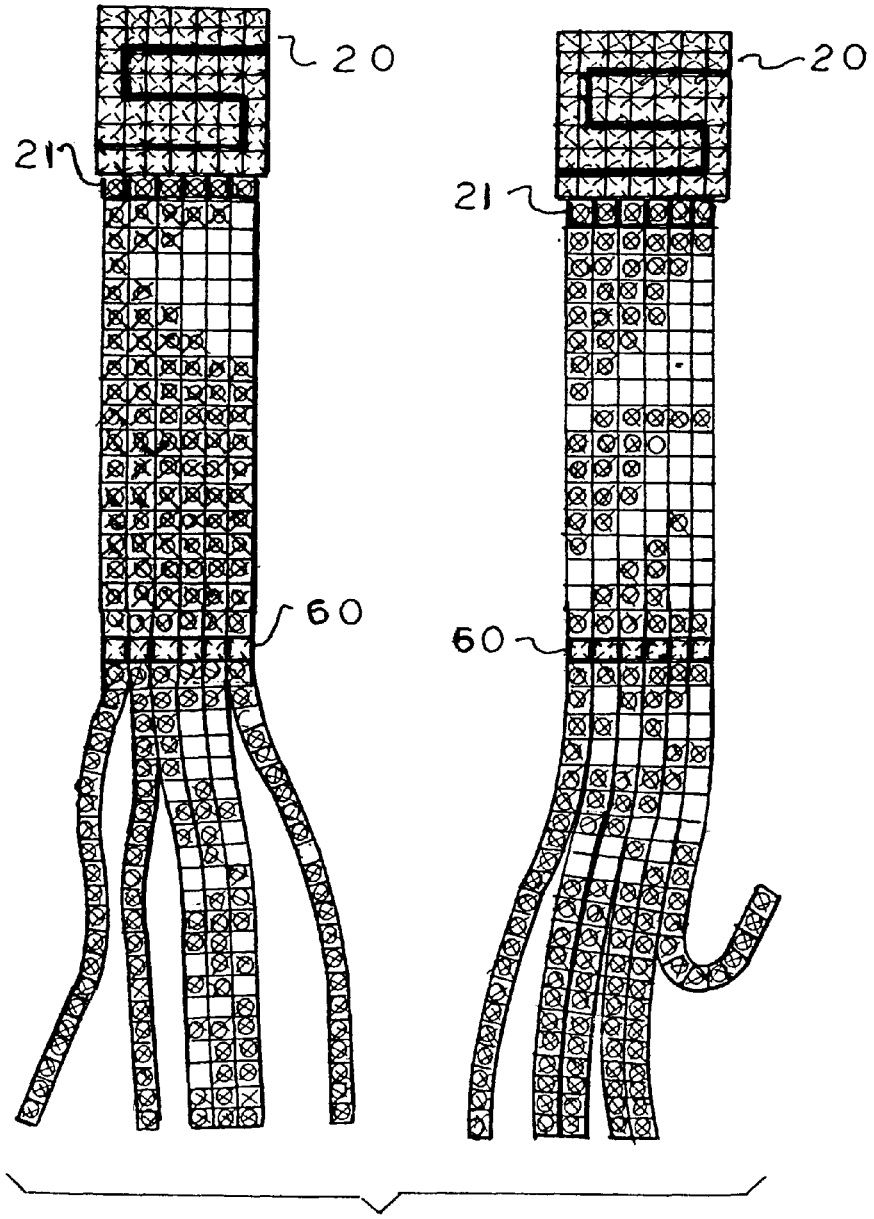
FIG. 6

FIG. 11
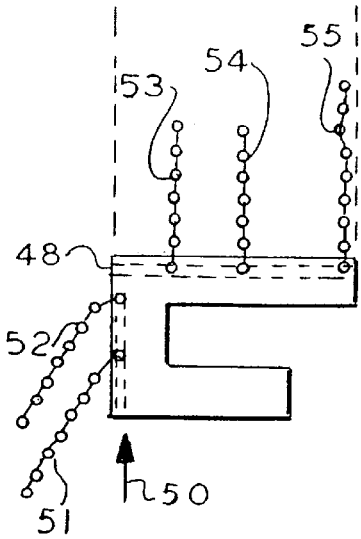
FIG. 12
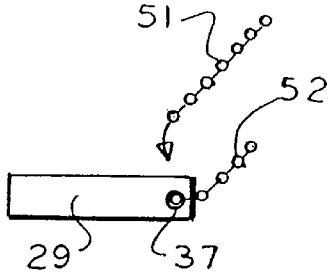
FIG. 10
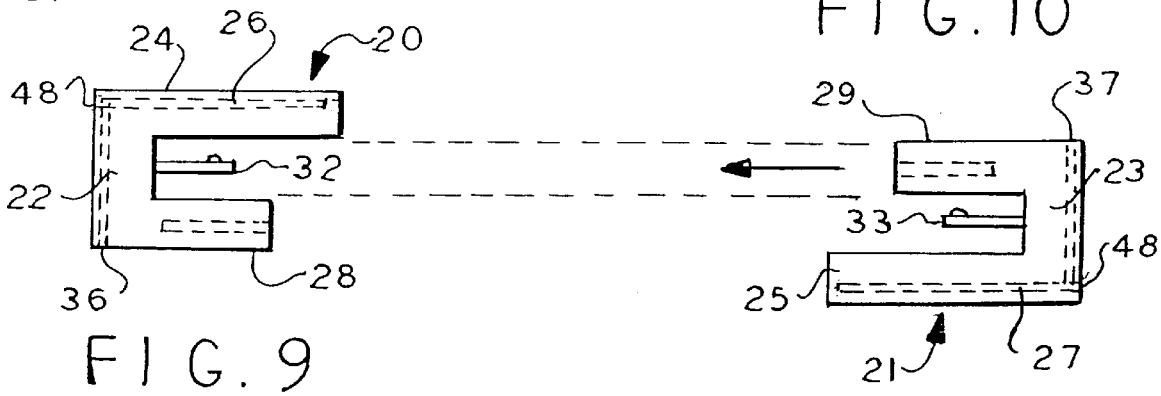
FIG. 9
FIG. 14
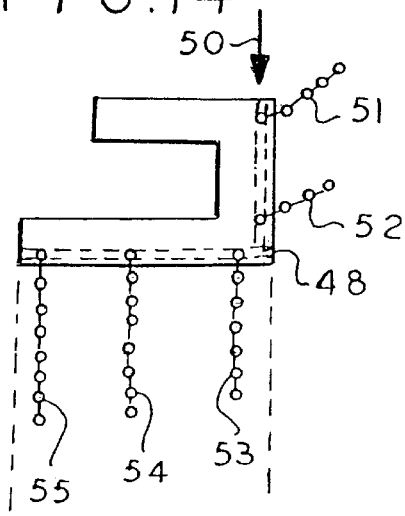
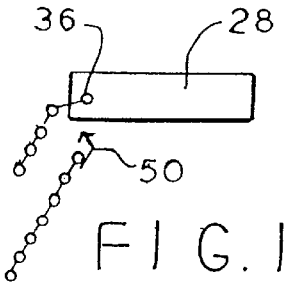
FIG. 13

JEWELRY PIECE

BACKGROUND OF THE INVENTION

1. Field of the Invention

This invention relates to a jewelry piece for holding the ends of a plurality of strings of ornamental objects such as strings of beads made of a valuable metal. The end bead of each such string is held in parallel side by side relation in the jewelry piece and can be readily disconnected therefrom or the jewelry piece can act as one member of a coupling for connecting a further series of bead strings together.

2. Description of the Prior Art

Jewelry is worn in a wide range of different styles and it is frequently the desire of the wearer to repeat a given pattern in a variety of jewelry items such as a necklace, bracelet, or earrings. A wearer may have a supply of a favorite item such as a beaded gold chain that she desires to use in different lengths in one or more of the aforementioned items.

The prior art has dealt with this problem in a variety of different ways, none of them being completely satisfactory. Miller U.S. design Pat. No. D57,180 discloses a bracelet made of a plurality of strings of beads held in parallel side by side relation but the strings are held in a permanent mount where removal or rearrangement is difficult. U.S. Pat. No. 1,646,999 to Goodridge discloses a spacer bar that can be closed over several rows of parallel beads to hold them in a desired spaced relation but again the bar, once clamped is difficult to pry open and change the relationship of the rows.

McFarland U.S. Pat. No. 2,644,992 teaches a bead chain clamp for jewelry with a pair of connectable end members, each having a plurality of individual slots for insertion of the end bead of a string of beads. Each end bead must be inserted in its own respective slot. U.S. Pat. No. 4,628,708 to Ivey discloses a jewelry chain organizer that clamps around parallel rows of bead chains that are already in a desired arrangement. Romano U.S. Pat. No. 6,014,871 teaches a jewelry system with a necklace that can be disassembled and reconfigured to form a single or double strand bracelet through a series of disconnectable elements.

SUMMARY OF THE INVENTION

This invention relates to a jewelry piece for holding the ends of a plurality of strings of ornamental objects such as beads made of a valuable metal. Such strings are held in parallel side by side relation in the jewelry piece and can be readily disconnected therefrom or the jewelry piece can act as one member of a coupling for connecting a further series of bead strings together. The jewelry piece is a flat U shaped body with a bight and a long leg and a short leg extending perpendicularly from the bight. When used as a coupling two U shaped jewelry pieces are interdigitated with the short leg of each jewelry piece being positioned between the legs of an adjacent jewelry piece. A slot is formed in the outer peripheral edge of each jewelry piece, at least along the edge of the long leg and an end bead of a chain of beads can be fitted into an end opening of the slot so that only the end bead is held in the slot and the remainder of the string can hang out from the slot and be supported by the jewelry piece.

The end bead of each of a plurality bead strings can each be fitted side by side into the slot so that the strings will be supported from the piece in parallel side by side relation. When all of the bead strings are cut to the same length, a second jewelry piece can be similarly fitted to the second end. Then the two jewelry pieces can be interdigitated together to form a coupling for a bracelet or a necklace, ring, or belt. If the second end is left free, that is, without a jewelry piece being attached thereto, then a special pin can be a connected to the jewelry piece so it, with the bead strings hanging from the slot, the jewelry piece and beads can be used as a brooch, pin, tie clip, tie pin, cufflink or pendent. Alternatively the bead strings can be cut to different lengths for decorative effect. Of course a bracelet, a necklace, and a brooch can all be formed so that the wearer can have a matching ensemble of jewelry.

BRIEF DESCRIPTION OF THE DRAWINGS

FIG. 6 is a front elevational view of a pair of earrings formed by using strings of parallel side by side beads held in two interdigitated jewelry pieces as shown in FIG. 1;

FIG. 7 is a front view of a special earring hook used in conjunction with the jewelry pieces shown in FIG. 6;

FIGS. 9 and 10 are separate views of the U shaped jewelry pieces shown in FIG. 1 showing they are mirror images of each other;

FIGS. 11 and 14 are plan views similar to FIGS. 9 and 10 but showing the steps of inserting bead strings; and FIGS. 12 and 13 are views of the peripheral edge of the short legs, showing a starting step for bead insertion.

DETAILED DESCRIPTION OF PREFERRED EMBODIMENTS

Figure 4:
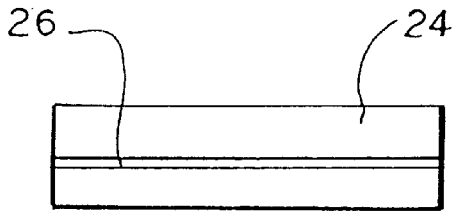
FIG. 4 is an top end view of FIG. 1, showing the top edge of the long leg of the upper U shaped jewelry piece.
Figure 1:
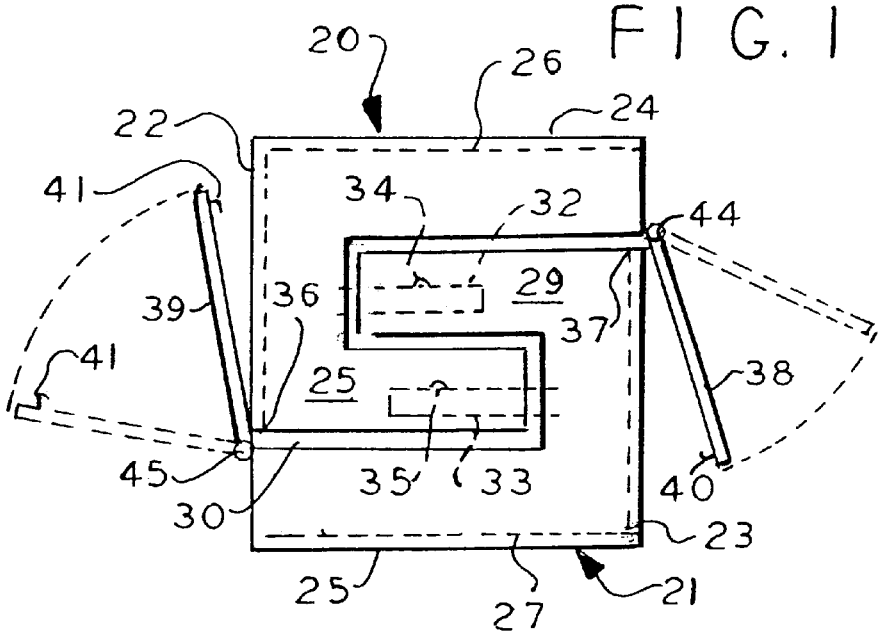
FIG. 1 is a plan view of two similar U shaped jewelry pieces interdigitated together to form a coupling. For the sake of clarity no strings of beads or other object are shown secured thereto.
Figure 2:
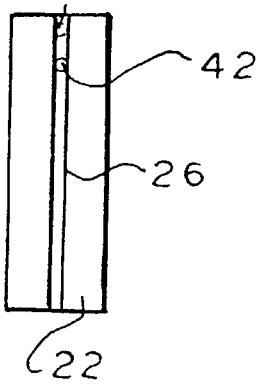
FIG. 2 is a left end view of the bight portion of the upper U shaped jewelry piece of FIG. 1.
Figure 3:
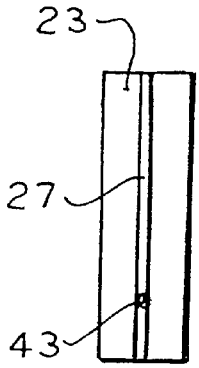
FIG. 3 is a right end view of the bight portion of the lower U shaped jewelry piece of FIG. 1.
Figure 5:
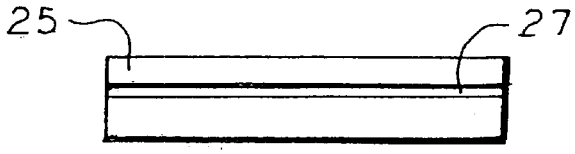
FIG. 5 is a bottom end view of FIG. 1, showing a side view of the long leg of the lower U shaped jewelry piece.

FIG. 1 shows two U shaped bodies interdigitated with each other to form a coupling between two units of jewelry, each intended to support a plurality of strings of beaded chains. For clarity the strings of beaded chains are not shown in FIG. 1, but will be discussed later, particularly in connection with FIGS. 9–14. The two U shaped bodies of FIG. 1 are preferably identical and are shown here as mirror images of each other. The parts of upper U shaped flat body 20 are identified with even numbers and the comparable part of lower U shaped body 21 are identified with the next highest odd number.

Upper U shaped body 20 and lower U shaped body 21 each have a bight portion 22,23 and two legs perpendicular thereto. Long legs 24,25 are a one end bight portions 22,23 and short legs 28,29 are at the other end of the bight portions. The two U shaped bodies are interdigitated with short leg 29 of lower body 21 lying between legs 24 and 28 of upper body 20. The U shaped bodies 20 and 21 are held together by springs tongues 32,33 which extend outward from their respective bight portions 22,23. Each tongue has a detent 34,35 that will engage in a sidewall of an opening in the end of the facing short leg 28,29. Each U shaped body 20,21 has a thickness (see side views FIGS. 2–5) presenting a peripheral edge with a slot 26,27 in at least the long legs 24,25 and preferably also in bight portions 22,23. That slot has a cross sections that is narrow at one side and wide at the opposite side, commonly referred to as a "keyhole shape" with the wide portion of the slot being inside the body and the narrow portion of the slot forming an opening in the peripheral edge, see side views FIGS. 2–5. The entrance to slot 26,27 is at the proximal end, shown as slot opening 36,37 which, are at the juncture of bight 22,23 and short leg 28,29. The distal end of each slot is within the long leg 24,25 and is closed. The locations of slot openings 36,37 makes it convenient to fit an end bead of a bead string into slot 26,27 and slide that bead along the length of the slot. Thus a bead string or a plurality of bead strings can be supported from a slot in parallel side by side relation as will be later explained in detail in connection with FIGS. 9–14.

A safety catch is provided between the two U shaped bodies 20,21 in the form of a link 38,39 that is pivoted at point 44,45 to swing in an arc toward the opposite body. At the end of each link is a projection 40,41 which will enter an opening 42,43 to secure the link firmly in place. The openings 42,43 are preferably of a small diameter so beads cannot pass through them. The projection 40,41 can serve a dual purpose: to keep the link in place as just discussed and to extend into the slot 26,27 to prevent beads in the slot from sliding out when the two bodies are linked together. At the same time when the bodies are unlinked, it is easy to slide out one or more of the end beads of a bead string to remove that string from the slot and thus from the body 20,21. It is contemplated that the link 39,40 may be a rigid arm as shown or be flexible, such as a chain. It is also contemplated that a single link be used rather than two links as shown.

Referring now to the remaining drawings, FIG. 6 shows a pair of earrings where each earring is formed by two bodies 20,21 connected together with a plurality of bead strings extending only from slot 27 in lower body 21. The distal ends of the bead strings are of random length and hanging freely. The slot 26 in upper body 20 is not used for beads, it instead is used to support a special earring hook 47 as shown in FIG. 7. That hook has a first arm 46 to slide into slot 26 by entry through opening 48 in the peripheral edge of the bight portion 22 of upper body 20. A second arm 49 of earring hook 471s smoothly curved to pass through a hole in the wearers ear. Alternatively, the hook 47 may be made with an ear clamp for users who do not have pierced ears. Opening 48, like openings 42,43 is preferably of a small diameter so beads cannot pass through it. Opening 48 needs only to be large enough to permit entry of first arm 46 of earring hook 47.

Figure 8:
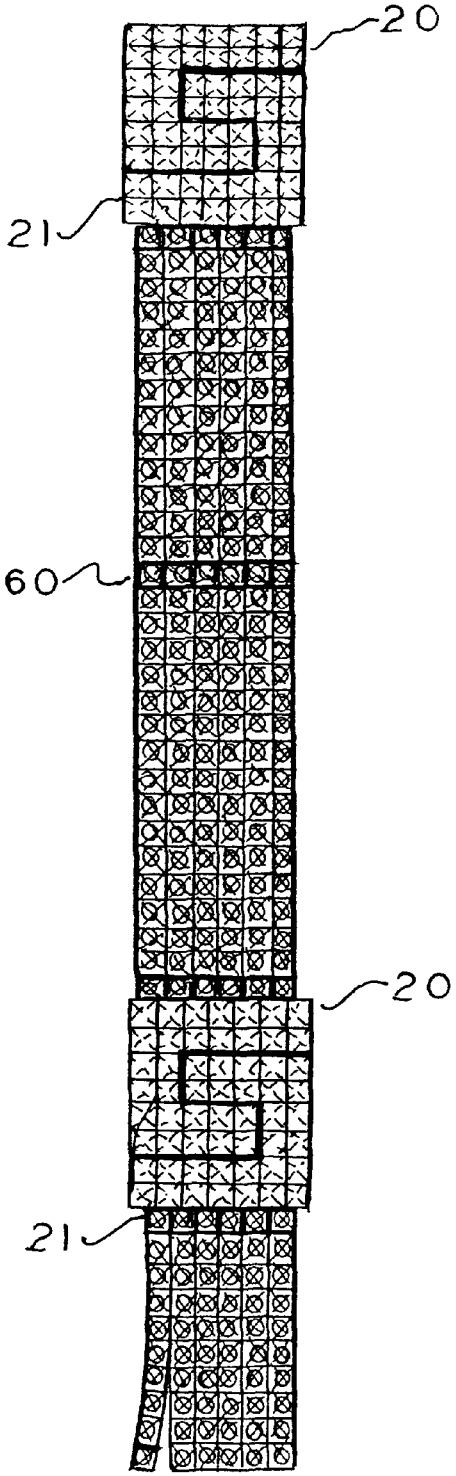
FIG. 8 is a plan view of a series of parallel bead strings, each coupled to the other by the two interdigitated jewelry pieces as shown in FIG. 1.

In FIGS. 6 and 8 numeral 60 identifies a spacing bar that is placed around the parallel strings of beads, especially in the center portion of long runs, or near the loose hanging portion of earring beads to keep the strings in alignment.

FIGS. 9 and 10 show upper U shaped body 20 and lower U shaped body 21 separated as when strings of beads are loaded into slots 26 and 27. FIGS. 9–14 are organized so upper body 20 is shown in the left three figures and lower body 21 is shown in the right three figures. For convenience and clarity only left three FIGS. 11, 9 and 13 will be discussed, it being understood that the procedure for the right three figures is identical. In these drawings arrow 50 designates the starting point for loading strings of beads, the end bead of a string 51 is pushed into slot opening 36, see FIGS. 11 and 13 that show an end bead being fed into opening 36. One can then grip the beads hanging out of slot 26 and move a bead string progressively through the slot 26.

The bead strings 51, 52, 53, 54, and 55 refer diagramatically to progressive positions of bead string movement. It is to be understood that these drawings are only for the purpose of illustrating the method of loading and many more strings would be involved in an actual necklace, earring, or brooch; see FIGS. 6 and 8. Referring to FIG. 11, a string of beads is pulled the location of bead string 52 and is then pulled to the right and across the length of long arm 24, see bead positions 53–55. First row 55 will rest against the dead end of slot 26, the second string will rest against the first string, etc until the entire length of long arm 24 is filled with bead rows. At that time it is not necessary to take any further step, other than to close link 39 so projection 41 enters opening 42 and blocks off slot 26 so that the bead cannot be removed. When one wants to remove the beads, it is a simple matter to reverse the above procedure.

In an alternative embodiment of the invention shown in FIGS. 15–18 which has the same U shaped bodies as 20 and 21, spring tongues 61 and 63 are in an elongated shape, being attached to the U shape bodies 20 and 21 at 62 and 64, and having a curve 65 and 67 at one end and an upstanding member 69 and 71 at the other end. The spring tongues hold the U shaped bodies 20 and 21 together. To release them, upstanding members 69 and 71 are pushed downwardly, as shown at arrow 72, to press the legs 73 together and cause the spring tongues to slide out of the corresponding openings as described previously with the first mentioned embodiment. By pressing the upstanding member, bright 75 in the upper leg of the spring tongue it will disengage from the corresponding projection 77 in the opening 78 in the U shaped body as shown in FIG. 19 and the U shaped member will disengage.

Figure 16:
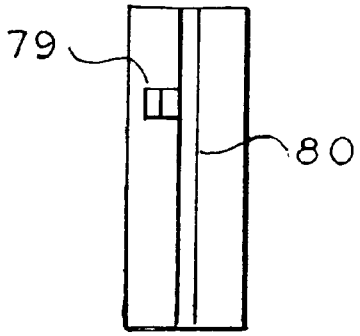
FIG. 16 is a view of the embodiment of FIG. 15 showing a side view.
Figure 15:
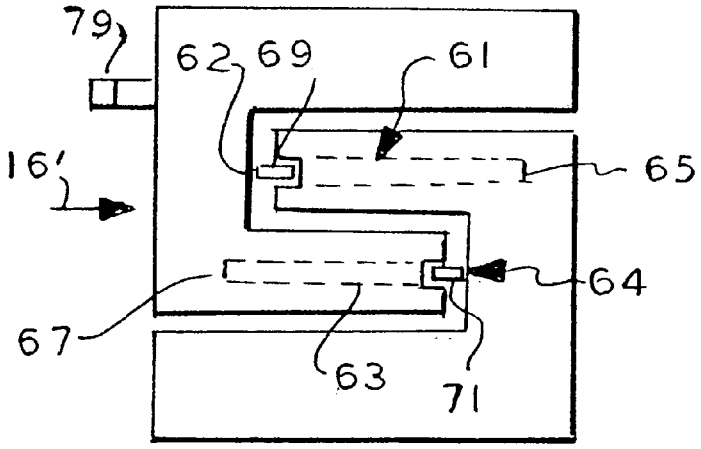
FIG. 15 is an alternative embodiment of the invention.
Figure 17:
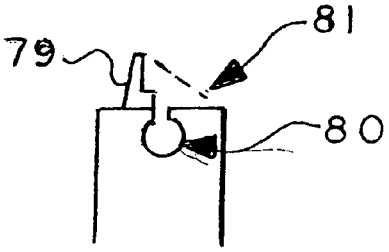
FIG. 17 is a view of the embodiment of FIG. 15 showing another side view.
Figure 18:
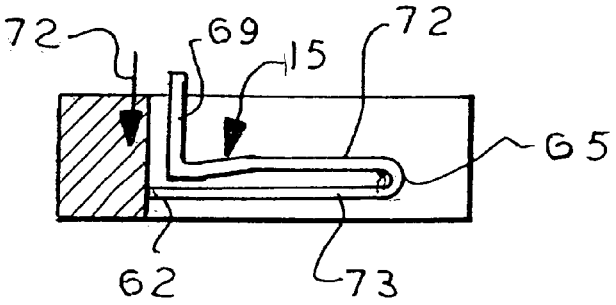
FIG. 18 is a cut away view of a U shaped member of FIG. 15.

There is also a safety latch 79 provided as shown in FIGS. 15–17, which swings up and down as shown by the dotted lines 81 in FIG. 17 to open and close channel 80 into which the beaded chains are passed to prevent them form falling out.

Figure 20:
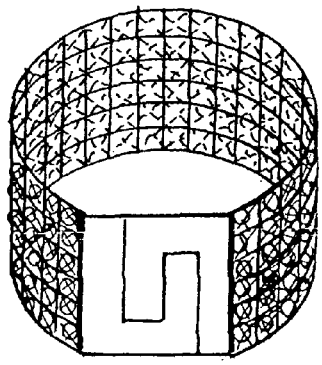
FIG. 20 is a view of the invention as a ring.
Figure 19:
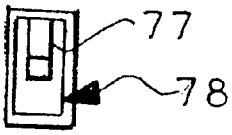
FIG. 19 is a side view of FIG. 18.

The invention may be used for a ring as shown in FIG. 20 or the U shaped brooches may be used alone as shown in FIG. 19 to form pins, tie tacks, tie clips, broaches, or cuff links claims may also be attached to them. There items have standard attaching means: such as a clasp or pin, or for the cuff links standards cuff link attaching means.

Figure 21:
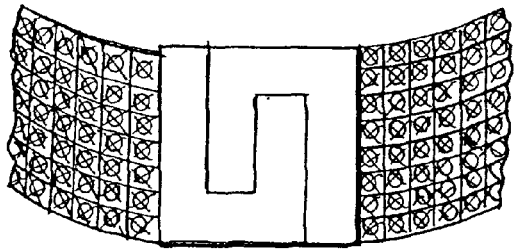
FIG. 21 is a view of the invention as a belt
Figure 19A:
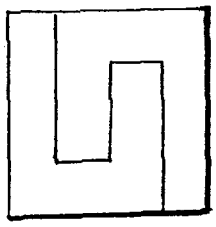
FIG. 19A is a view of the invention as a pendant, pin, broach or cufflink.

In FIG. 20, shows the invention with the beaded chains forming a ring. FIG. 21, shows the invention forming a belt or bracelet.

It is understood that the U shaped members may be formed in shapes other than U's, such as, interlocked W's or Y's or one member may be one shape and the other a different shape, e.g. one may look like a W and one a U or an O.

Also it should be understood that the piece and the charms may be made from precious metals, non-precious metals and even non metals, such as stone and plastic.

In the foregoing description of the invention, reference to the drawings, certain terms have been used for conciseness, clarity and comprehension. However, no unnecessary limitations are to be implied from or because of the terms used beyond the requirements of the prior art. Such terms are used for descriptive purposes and are intended to be broadly construed. The description and illustrations of the invention are by way of example, and the scope of the invention is not limited to the exact details shown, represented, or described.

What is claimed is:

1. A jewelry piece for holding a plurality of strings of ornamental objects in parallel side by side relation comprising:

a unitary U shaped flat body having a bight portion, a long leg, and a short leg, each leg extending generally perpendicular to said bight portion;

said body having a thickness presenting a peripheral outer edge on said bight portion and said legs;

a slot, having a keyhole shaped cross section, in said peripheral edge on at least one of said bight portion and legs;

said keyhole shaped slot having a narrow portion opening through said peripheral edge and a wide portion within said body, said wide port on having a size and shape to accept an end piece of a jewelry chain;

said slot having a closed distal end and an open proximal end for entry of jewelry chain end pieces into said slot so that a plurality of jewelry chains can be slidingly fitted seriatim into said slot so that the chains will lie in parallel side by side relation supported from said slot.

2. The jewelry piece of claim 1 including a closure means for said slot proximal end opening.

3. The jewelry piece of claim 1 in which said slot is located in said long leg.

4. The jewelry piece of claim 1 in which said slot is continuous in said bight portion and in said long leg.

5. The jewelry piece of claim 4 in which the open proximal end of the slot is in the short leg, adjacent the juncture of the short leg with the bight portion.

6. The jewelry piece of claim 1 including an opening in said body in alignment with an end of said slot and a hook-shaped earring wire having a first end shaped for attachment to a wearer's ear and a second end shaped for entry into said slot opening.

7. The jewelry piece of claim 1 in combination with a plurality of beaded chains, made of a valuable metal, positioned in said slot.

8. A jewelry piece for holding a plurality of strings of ornamental objects in parallel side by side relation comprising:

two substantially identical flat U shaped bodies for forming a rectangular assembled body, each U shaped body having a bight portion, a long leg, and a short leg, each leg extending generally perpendicular to said bight portion;

said u shaped bodies each being of a size and shape to be interdigitated with the short leg of each body fitted between the legs of the other body so that the resulting assembled rectangular body has a first pair of opposite sides formed by said bight portions and a second pair of opposite sides formed by said long legs;

each said U shaped body having a thickness presenting a peripheral outer edge on said bight portion and said long leg;

a slot having a keyhole shaped cross section located in each U shaped body, each of said slots in each said U shaped body being in said peripheral edge on at least one of said bight portion and said long leg;

each of said keyhole shaped slots having a narrow portion opening through said peripheral edge and a wide portion within said body, said wide portion having a size and shape to accept end pieces of jewelry chains;

each of said slots having an open proximal end for entry of jewelry chain end pieces into said slots so that a plurality of jewelry chains can be slidingly fitted seriatim into said slots and the chains will lie in parallel side by side relation supported from said slots.

9. The jewelry piece of claim 8 including a closure means for each said slot proximal end opening.

10. The jewelry piece of claim 8 in which said slots are located in said long leg.

11. The jewelry piece of claim 8 in which said slots are continuous in said bight portion and in said long leg.

12. The jewelry piece of claim 8 in which the open proximal end of the slots is in the short leg, adjacent the juncture of the short leg with the bight portion.

13. The jewelry piece of claim 8 in which one of said U shaped bodies has a spring detent tongue projecting from said bight portion into a space between said legs; an opening in the end of the short leg of the other U shaped body positioned to engage said tongue when said two U shaped bodies are interdigitated.

14. The jewelry piece of claim 8 in which a safety catch is mounted on one of said U shaped bodies for engagement with the other U shaped body when interdigitated, said safety catch comprising a link pivotally mounted on one long leg to move into engagement with a securement means on the bight portion of the other U shaped body.

15. The jewelry piece of claim 14 in which said link is an arm and said securement means is an opening in a slot on the peripheral edge of said bight portion of the other U shaped body.

16. A method for maintaining a plurality of strings of ornamental objects in parallel side by side relation, said method comprising:

constructing a jewelry piece to have a unitary U shaped body with a bight portion, a long leg, and a short leg, both legs projecting generally perpendicularly from said bight portion, said body having a thickness presenting a peripheral edge on at least the outer portion of the long leg;

forming a slot in said peripheral edge, said slot having a keyhole shaped cross section with a narrow portion opening through said peripheral edge and a wide portion within said body;

forming said wide portion to have a size and shape to accept end pieces of jewelry chains;

fitting end pieces of jewelry chains seriatim into said slot by a sliding action so that a plurality of jewelry chains are supported from said slot and lie in parallel side by side relation;

closing off said slot to maintain said pieces therein.

17. A jewelry piece for holding a plurality of strings of ornamental objects comprising:

a unitary U shaped body having a bight portion;

said body having a thickness presenting a peripheral outer edge;

a slot, having a keyhole shaped cross section, in said peripheral edge;

said keyhole shaped slot having a narrow portion opening through said peripheral edge and a wide portion within said body, said wide portion having a size and shape to accept an end piece of a jewelry chain;

said slot having a closed distal end and an open proximal end for entry of jewelry chain end pieces into said slot so that a plurality of jewelry chains can be slidingly fitted into said slot so that the chains will be supported from said slot.

* * * * *